United States Patent [19]

McDonie et al.

[11] 4,339,469

[45] Jul. 13, 1982

[54] METHOD OF MAKING POTASSIUM, CESIUM, RUBIDIUM, ANTIMONY PHOTOCATHODE

[75] Inventors: Arthur F. McDonie, Lancaster; William K. Miller, Manheim, both of Pa.

[73] Assignee: RCA Corporation, New York, N.Y.

[21] Appl. No.: 284,258

[22] Filed: Jul. 17, 1981

Related U.S. Application Data

[62] Division of Ser. No. 98,698, Nov. 29, 1979, abandoned.

[51] Int. Cl.[3] ..... B05D 1/34; B05D 1/38; B05D 3/02

[52] U.S. Cl. ..... 427/10; 427/74

[58] Field of Search ..... 427/8, 10, 74

[56] References Cited

U.S. PATENT DOCUMENTS 3,434,876 11/1965 Stoudenheimer et al. ..... 117/211

3,498,834 2/1967 Rome et al. ..... 117/217

OTHER PUBLICATIONS

"Technique for Producing High-Sensitivity Rubidium-Cesium-Antimony Photocathodes" by Carl W. Morrison, Journal of Applied Physics, vol. 37, No. 2, Feb. 1966, pp. 713-715.

*Primary Examiner*—James R. Hoffman

*Attorney, Agent, or Firm*—Eugene M. Whitacre; Dennis H. Irlbeck; Vincent J. Coughlin, Jr.

[57] ABSTRACT

A base layer comprised of antimony and oxygen is formed on a substrate within an evacuated enclosure. Rubidium, potassium and cesium are then evaporated onto the base layer after which the substrate is heated to promote an activating reaction between the rubidium, potassium, cesium and antimony.

5 Claims, 3 Drawing Figures

METHOD OF MAKING POTASSIUM, CESIUM, RUBIDIUM, ANTIMONY PHOTOCATHODE

This is a division, of application Ser. No. 098,698, filed Nov. 29, 1979, now abandoned.

BACKGROUND OF THE INVENTION

This invention relates to photocathodes and more particularly to a photocathode comprising potassium, cesium, rubidium and antimony, and to methods of forming such a photocathode.

Some prior art photocathodes that comprise an initial deposit of antimony and one or more alkali metals include the cesium-antimony ($Cs_3Sb$) photocathode, the potassium-cesium-antimony ($K_2CsSb$) bialkali photocathode, the sodium-potassium-antimony ($Na_2KSb$) bialkali photocathode and the potassium-sodium-cesium-antimony ($(Cs)Na_2KSb$) multialkali photocathode. The cesium-antimony, or S-11 photocathode, has been supplanted in most applications by one of the above-mentioned bialkali photocathodes, each of which has a higher spectral sensitivity and quantum efficiency than the S-11 photocathode. With the exception of the potassium-sodium-cesium-antimony photocathode, commonly referred to as an S-20 photocathode, the photocathodes of the above-mentioned type are characterized by relatively high resistivity.

When a photocathode is deposited directly upon an insulating substrate, such as a glass faceplate of a photomultiplier tube, it is usually caused to overlap, at its periphery, a conductive layer, e.g., an evaporated aluminum film, connected to a source of suitable electrical potential, such as ground. Such a conductive layer serves to replenish emission electrons lost by the photocathode in operation. However, because of the relatively high resistivity of each of the above-mentioned bialkali photocathodes a relatively large voltage gradient is produced across the photocathode during operation. This voltage gradient distorts an electrostatic focusing field adjacent to the photocathode so as to adversely affect the focusing function of such field with consequent distortion in the output signal of the photomultiplier tube.

In certain applications where a photocathode is subjected to an intense source of radiation, such as light emitted by a scintillator, a photocathode having a high resistivity is not suitable because of the appreciable voltage gradient across the photocathode with its attendant adverse effect on tube performance.

In such an application either a transmissive conductive substrate must be dispersed on the glass faceplate between the photocathode and the radiation source to lower the resistivity of the photocathode, or a photocathode more conductive than a bialkali photocathode must be employed.

While the conductivity of the S-20 multialkali photocathode is satisfactory for use with an intense source of radiation, the S-20 -photocathode fabrication process is slow and costly. A typical cathode processing schedule for an S-20 multialkali photocathode requires a complex sequence of processing steps including alternately evaporating the alkali materials potassium, sodium and cesium with antimony until a maximum level of photocathode sensitivity is achieved. Such a schedule is described in U.S. Pat. No. 3,658,400 issued to F. A. Helvy on Apr. 25, 1972, and entitled "Method of Making a Multialkali Photocathode with Improved Sensitivity to Infrared Light and a Photocathode Made Thereby."

Photocathodes comprising rubidium as one of the constituents are well known in the art. For example, the superficially oxidized rubidium-cesium-antimony bialkali photocathode is disclosed by C. W. Morrison, in an article entitled, "Techniques for Producing High Sensitivity Rubidium-Cesium-Antimony Photocathodes", Journal of Applied Physics, Vol. 37, No. 2, Feb. 1966, pages 713–715, and also by A. H. Sommer, in *Photoemissive Materials,* John Wiley and Sons, Inc., New York, 1968, pages 126–127.

A rubidium-potassium-sodium-cesium-antimony multialkali photocathode is disclosed in U.S. Pat. No. 3,498,834, Rome et al., issued Mar. 3, 1970, entitled "Photoelectric Surfaces and Methods For their Production."

Both the superficially oxidized rubidium bialkali photocathode disclosed by Morrison and Sommer and the rubidium multialkali photocathode disclosed by Rome et al. require complex manufacturing processes and thus the photocathodes produced thereby are subject to considerable variations in quality and high manufacturing costs. Therefore these photocathodes are not suitable for photomultiplier tube applications where a low cost, high performance photocathode is required.

In addition to the above-mentioned prior art rubidium photocathodes, a rubidium-cesium-antimony bialkali photocathode is disclosed in a copending application of A. F. McDonie, Ser. No. 937,567, filed Aug. 28, 1978, entitled, "Rubidium-Cesium-Antimony Photocathode," assigned to the same assignee as the instant invention and now abandoned. The rubidium-cesium-antimony bialkali photocathode disclosed by McDonie provides the advantages of ease of photocathode processing and satisfactory conductivity; however, the spectral sensitivity of the aforementioned rubidium-cesium-antimony bialkali photocathode, in some photomultiplier tubes, is not as high as would be desired.

SUMMARY OF THE INVENTION

A photocathode includes a substrate and a base layer comprising antimony and oxygen on said substrate. A deposit of potassium, cesium and rubidium is disposed on the base layer.

DETAILED DESCRIPTION OF THE PREFERRED EMBODIMENT

Figure 1:
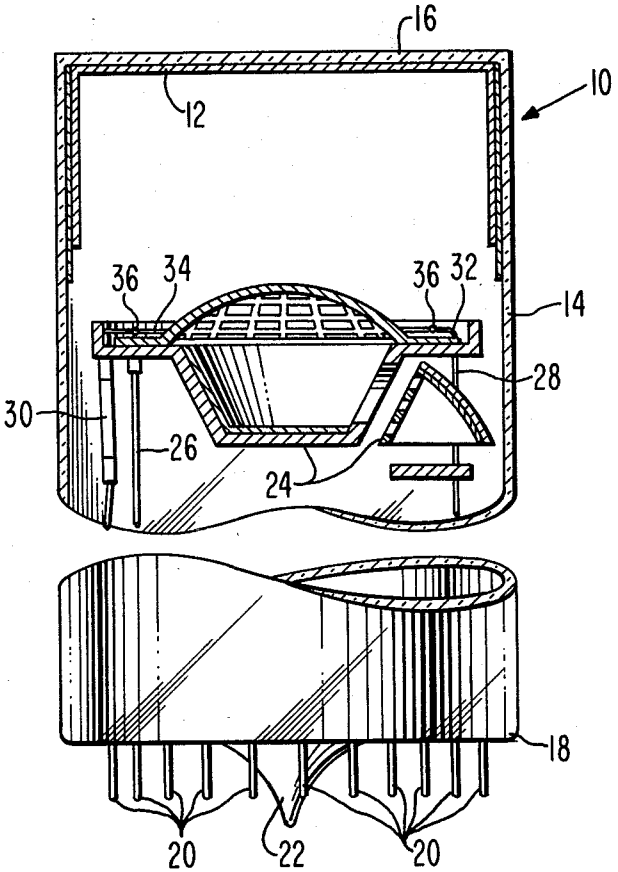
FIG. 1 is a sectional view of a phototube incorporating the novel photocathode.

In FIG. 1 of the drawing there is shown a photomultiplier tube 10 comprising a photoemissive cathode 12. The photomultiplier tube 10 is utilized herein by way of example, it being understood that any photosensitive device incorporating a photocathode may be used. The tube 10 has a tubular glass envelope 14. One end of the envelope 14 is closed by a substantially flat transparent glass faceplate 16, and the other end of the envelope 14 is closed by a glass stem 18 having a number of electrical lead-in pins 20 and an exhaust tubulation 22, shown as being "tipped off". Along the interior of the tube 10 are spaced a series of dynodes 24. The dynodes 24 may be formed of copper beryllium, nickel or molybdenum composition, although copper beryllium is preferred.

Mounted near the dynodes 24 are nickle wires 26 and 28 and a container 30. The nickle wires 26 and 28 are connected to a pair of platinum-clad molybdenum wire filaments 32 and 34. Attached to each of the platinum-clad molybdenum filaments 32 and 34 is a bead or pellet 36 of platinum-antimony. The pellet 36 is an antimony-platinum alloy comprising about 50% antimony and 50% platinum, by weight. The container 30 contains a substance for evaporating rubidium, potassium and cesium. The substance in container 30 is preferably a mixture of rubidium chromate, potassium chromate, cesium chromate and silicon. The mixture may comprise five to thirty percent by weight of rubidium chromate and equal parts, by weight, of potassium chromate and cesium chromate; however, fifteen percent rubidium chromate is preferred. The nickle wires 26 and 28 are suitably connected to electrical current sources (not shown) to pass a current through the pins 20 so that the beads 36 can be activated by electrical resistance heating. The container 30 can also be activated by electrical resistance heating.

Figure 2:
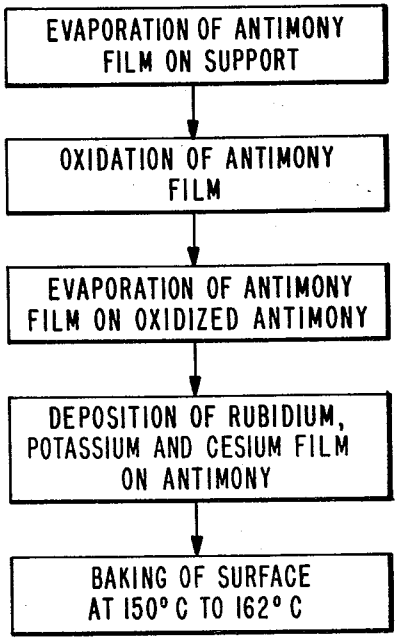
FIG. 2 is a flow chart showing a preferred schedule of steps in the formation of the novel photocathode of FIG. 1.

The photocathode 12 in one example of the present method is made in accordance with the following procedure, which is summarized in the flowchart shown in FIG. 2. The exhaust tubulation 22 is connected, prior to tip-off, to an exhaust system (not shown) and the tube envelope 14 is evacuated until the pressure in the envelope 14 is of the order of $10^{-5}$ Torr or less. The tube 10 is then baked between 280°-300° C. for about 2½ to 3 hours to remove occluded gases from the interior tube components. The tube 10 is then cooled at 5°-10° C. per minute to room temperature.

At room temperature (about 23° C.) antimony is evaporated onto the faceplate from the platinum-antimony beads 36 and the transmission is reduced from 100 percent down to about 90 percent of the original value of 100 percent. In order to measure the amount of material deposited on the faceplate 16, light transmission can be measured in the manner disclosed in U.S. Pat. No. 2,676,282 to Polkosky issued on Apr. 20, 1954. A light indicator (not shown) can be set to show a scale reading of 100 at full transmission of light through the faceplate 14. Evaporation of antimony is continued until the transmission through the faceplate is 90 percent of its original value of 100 percent.

Oxygen is next introduced into the envelope 14 through the exhaust tubulation 22 to a pressure of about 280-320 microns. The antimony film is then oxidized by using a high frequency electrode (not shown) placed over the faceplate 16. The high frequency of the electrode produces within the envelope 14 a gaseous discharge which causes the antimony to react with the oxygen in the envelope 14. The electrode is held over the faceplate for about 5 to 20 seconds. This method of oxidizing metal films within the envelope is well-known and completely described in U.S. Pat. No. 2,020,305 to Essig issued on Nov. 12, 1935. The oxygen within the envelope is then removed and the light transmission indicator is reset to 100.

Antimony from the platinum-antimony beads 36 is again evaporated onto the faceplate and the transmission, which was reset to 100 is reduced from 100 percent down to 70 percent.

The alkali materials, rubidium, potassium and cesium, are then released into the evacuated envelope 14, for subsequent activation of the antimony film, by heating the container 30 to a sufficiently high temperature to evaporate the substance contained therein. Preferably the rubidium, potassium and cesium are released simultaneously, but the container 30 may be arranged for release of the alkali materials sequentially. The container 30 may be heated by passing a current therethrough until sufficient alkali materials are released to completely react with the total amount of antimony on the faceplate 16. In order to insure that all the antimony has reacted with the rubidium, potassium and cesium, an excess amount of the above-indicated alkali materials are introduced into the envelope 14.

An oven (not shown) which has been preheated to 100°-130° C. is lowered over the tube 10. The temperature of the oven is increased to about 150° C. to 162° C. and the tube is baked for about 30 to 40 minutes to promote an activating or sensitizing reaction between the rubidium, potassium, cesium and antimony. The bake is continued until the photocathode sensitivity reaches a maximum and begins to decrease and the ohmic leakage is reduced to a minimum. At this point, the tube is slowly cooled to approximately 100° C. at a rate of approximately 5 degrees per minute. When the tube reaches 100° C., the tube is allowed to cool freely to room temperature. After the exhaust tubulation 22 is sealed and th tube 10 is removed from the exhaust system, the tube 10 is operative.

Photocathodes made in accordance with the above described method have been measured to have luminous sensitivities consistently within the range of 100 to 150 microamperes per lumen (μa/l) with a typical sensitivity of 120 microamperes per lumen (μa/l). The blue sensitivity of photocathodes made in accordance with the described method have a range of 10 to 11.7 microamperes per lumen (μa/l) with a typical blue sensitivity of 10.5 microamperes per lumen (μa/l) compared to a typical blue sensitivity of 9.5 microamperes per lumen for other commonly used photocathodes.

Figure 3:
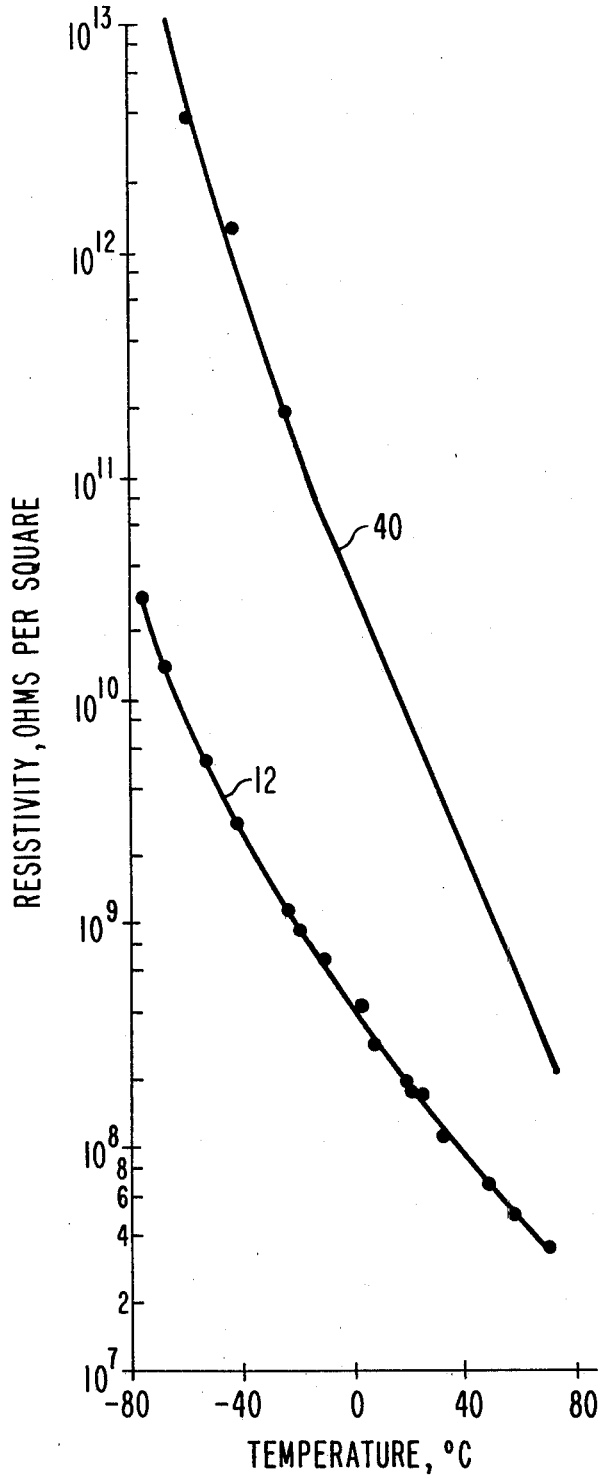
FIG. 3 is a graph comparing the resistivity versus temperature of the novel photocathode and a prior-art bialkali photocathode.

As shown in FIG. 3 which plots photocathode resistivity in ohms per square as a function of temperature, the photocathode 12, made in accordance with the above-described method has been measured to have an electrical resistivity ranging from 0.1 to 0.01 the resistivity of a prior-art $K_2CsSb$ bialkali photocathode 40. The term "ohms per square" is defined in U.s. Pat. No. 2,849,538 issued to N. Pritikin on Aug. 26, 1958 as "the resistance of a square area to current passing between opposed edges of such square, the size of the square being of no consequence since the width of the current path varies directly with the length of the current path, and is, in fact, equal thereto." In certain operating environments, e.g. where relatively high values of photocathode current are drawn, such as exposure of the photocathode to an intense source of radiation, the prior-art $K_2CsSb$ bialkali photocathode would require an additional conductive substrate disposed between the photocathode and the radiation sources to achieve the same photocathode conductivity as the present potassium-cesium-rubidium-antimony photocathode. Such a conductive substrate reduces the effective transmission of the radiation source and correspondingly decreases the relative spectral sensitivity of the prior-art bialkali photocathode.

It has been found that in a photomultiplier tube structures utilizing copper beryllium dynodes such as that disclosed herein and shown in FIG. 1, the potassium-cesium-rubidium-antimony photocathode made in accordance with the above-described method has a greater spectral sensitivity than the rubidium-cesium-antimony bialkali photocathode disclosed in copending application Ser. No. 937,567, filed Aug. 28, 1978, and now abandoned. It is believed that the potassium-cesium-rubidium-antimony photocathode is more compatable with the preferred copper beryllium dynode material than is the rubidium-cesium-antimony photocathode although the reason is not understood.

What is claimed is:

1. A method of making a photocathode including the steps of:

(a) forming a base layer comprising antimony and oxygen on a substrate, (b) evaporating potassium, cesium and rubidium from at least one container onto the base layer, said base layer being maintained at room temperature during said evaporation, and (c) sensitizing said photocathode by baking said substrate at a temperature between 150° to 162° C. until the photocathode sensitivity reaches a maximum value.

2. The method defined in claim 1 wherein said step of forming the base layer includes:

i. cleaning and degassing a transparent substrate surface by heating said substrate for about 3 hours to a temperature of about 300° C. in a vacuum, ii. cooling said substrate to room temperature and depositing a first antimony layer on said surface with a light transmission therethrough of 90 percent, iii. oxidizing said antimony layer to form an antimony oxide film, and iv. depositing a second antimony layer on said antimony oxide film with a total light transmission through said substrate, said antimony oxide film and said second antimony layer of about 63 percent.

3. The method defined in claim 1 wherein said sensitizing step includes:

i. placing said substrate in an oven which has been preheated to a temperature between 100° C. and 130° C., ii. increasing the temperature of said oven to said substrate baking temperature, and iii. cooling said substrate from the baking temperature at which the above step ii is carried out, said cooling being at a rate of about 5° C. per minute to a temperature of approximately 100° C.

4. The method defined in claim 1 said potassium, cesium and rubidium are evaporated simultaneously from a single container.

5. A method of forming a photosensitive cathode in an enclosure, comprising the steps of:

(a) evacuating said enclosure;

(b) depositing a first film of antimony on a transparent substrate in said enclosure with a light transmission through said antimony film and said substrate of 90 percent, said substrate being maintained at room temperature;

(c) oxidizing said first film of antimony to form an antimony oxide film;

(d) depositing a second film of antimony on said antimony oxide film with a total light transmission through said substrate, said antimony oxide film and said second film of antimony of 63 percent;

(e) simultaneously evaporating rubidium, potassium and cesium from a single container to react with said total amount of antimony;

(f) heating said substrate at a temperature between 150° to 162° C. for about 30–40 minutes;

(g) slowly cooling said substrate at a rate of about 5° C. per minute to a temperature of approximately 100° C.; and (h) freely cooling said substrate to room temperature.

* * * * *

UNITED STATES PATENT AND TRADEMARK OFFICE

CERTIFICATE OF CORRECTION

PATENT NO. : 4,339,469

DATED : 7/13/82

INVENTOR(S) : Arthur Frederick McDonie et al.

It is certified that error appears in the above-identified patent and that said Letters Patent is hereby corrected as shown below:

| | |
|---|---|
| Column 1, Line 28 | "type" should be -- types -- ; |
| Column 1, Line 53 | "dispersed" should be -- disposed -- ; |
| Column 3, Line 48 | "14" should read -- 16 -- ; and |
| Column 4, Line 29 | "th" should read -- the -- . |

Signed and Sealed this

*Fourteenth* Day of *September 1982*

[SEAL]

*Attest:*

GERALD J. MOSSINGHOFF

*Attesting Officer*

*Commissioner of Patents and Trademarks*